US009102498B2

(12) United States Patent
Bartesaghi

(10) Patent No.: US 9,102,498 B2
(45) Date of Patent: Aug. 11, 2015

(54) DEVICE FOR THE FOLDING OF FLEXIBLE MATERIAL

(75) Inventor: Angelo Bartesaghi, Milan (IT)

(73) Assignee: OMET S.R.L., Lecco (IT)

( * ) Notice: Subject to any disclaimer, the term of this patent is extended or adjusted under 35 U.S.C. 154(b) by 477 days.

(21) Appl. No.: 12/226,947

(22) PCT Filed: May 11, 2007

(86) PCT No.: PCT/IB2007/001288

§ 371 (c)(1),
(2), (4) Date: Oct. 31, 2008

(87) PCT Pub. No.: WO2007/135525

PCT Pub. Date: Nov. 29, 2007

(65) Prior Publication Data

US 2009/0239728 A1 Sep. 24, 2009

(30) Foreign Application Priority Data

May 16, 2006 (IT) ..... MI2006A0961

(51) Int. Cl.
*B31F 1/10* (2006.01)
*B65H 45/20* (2006.01)

(52) U.S. Cl.
CPC ..... *B65H 45/20* (2013.01)

(58) Field of Classification Search
CPC ..... B65H 45/20; B65H 45/18; B65H 45/162
USPC ..... 493/430, 445, 449, 343, 344, 360, 434, 493/435, 395, 416, 428, 444
See application file for complete search history.

(56) References Cited

U.S. PATENT DOCUMENTS

| | | | | |
|---|---|---|---|---|
| 1,871,301 | A | 8/1932 | Campbell | |
| 2,468,254 | A | 4/1949 | Deloye | |
| 3,709,077 | A * | 1/1973 | Trogan et al. | 83/152 |
| 4,270,744 | A * | 6/1981 | Trogan | 493/430 |
| 4,822,328 | A * | 4/1989 | Bertolini et al. | 493/425 |
| 4,917,665 | A * | 4/1990 | Couturier | 493/472 |
| 4,985,013 | A * | 1/1991 | van der Werff et al. | 493/444 |
| 5,000,729 | A * | 3/1991 | Yamauchi | 493/359 |

(Continued)

FOREIGN PATENT DOCUMENTS

| | | |
|---|---|---|
| EP | 1 520 819 A | 4/2005 |
| IT | 1 274 311 B | 7/1997 |

OTHER PUBLICATIONS

PCT Search Report dated Mar. 11, 2008.

*Primary Examiner* — Gloria R Weeks
(74) *Attorney, Agent, or Firm* — Hedman & Costigan, P.C.; James V. Costigan; Kathleen A. Costigan

(57) ABSTRACT

A device for the folding of flexible material in the form of a continuous strip (10) or single sheets, of the type having a pair of parallel and opposite rolls (12, 14) respectively equipped with at least one gripping element (18), having at least one moveable jaw (20) and at least one fixed jaw (22), and at least one comb element (16) situated along directrix lines parallel to the axes of the respective rolls (12, 14). The comb elements (16) are assembled on an actuator group (50) inside each of the rolls (12, 14) to move them from a substantially withdrawn position with respect to the surface of the roll (12, 14) to a protruding position, whereas the moveable jaws (20) of the gripping element (18) are assembled on an actuator group (52) inside each of the rolls (12, 14).

4 Claims, 3 Drawing Sheets

(56) References Cited

U.S. PATENT DOCUMENTS

| | | | | | |
|---|---|---|---|---|---|
| 5,147,273 | A * | 9/1992 | Rottmann et al. | ..... | 493/349 |
| 5,310,398 | A * | 5/1994 | Yoneyama | ..... | 493/430 |
| 5,522,586 | A * | 6/1996 | Bennett et al. | ..... | 270/8 |
| 5,702,341 | A * | 12/1997 | Keilhau | ..... | 493/426 |
| 6,159,138 | A * | 12/2000 | Lanvin et al. | ..... | 493/359 |
| 6,942,610 | B2 * | 9/2005 | St. Germain et al. | ..... | 493/424 |
| 7,097,607 | B2 * | 8/2006 | De Matteis | ..... | 493/424 |
| 7,264,583 | B2 * | 9/2007 | Gelli et al. | ..... | 493/430 |
| 7,458,927 | B2 * | 12/2008 | Kauppila et al. | ..... | 493/435 |
| 7,771,337 | B2 * | 8/2010 | White et al. | ..... | 493/445 |
| 8,123,655 | B2 * | 2/2012 | Endo | ..... | 477/5 |
| 8,696,537 | B2 * | 4/2014 | Cline et al. | ..... | 493/433 |

* cited by examiner

DEVICE FOR THE FOLDING OF FLEXIBLE MATERIAL

The present invention relates to a device for the folding of flexible material in the form of a continuous strip or single sheets and, in particular, to the perfectioning of a device of the type equipped with rolls for the zigzag folding of the above material, for example for producing napkins or paper handkerchiefs.

A similar device in fact comprises a pair of parallel and opposite rolls which rotate at the same rate in opposite directions. The flexible material, for example paper or the like, is entrained between the two rolls which are respectively equipped with at least one gripping element and at least one comb element situated along directrix lines parallel to the axes of the rolls. The folding is obtained by means of the coordinated action of the comb element which, by protruding with respect to the surface of a roll, pushes the sheet of flexible material between the jaws of the gripping element on the opposite roll, the closing of the jaws creating the desired folding.

The jaws of the gripping element generally consist of a fix jaw, situated along a substantially radial surface of the roll, and a moveable jaw activated, for example, by means of a cam mechanism.

In an embodiment of the known type of these folding devices, the comb element is hinged with an axis parallel to the axis of the roll and is pushed towards the operating position by a spring. The latter gives way under the closing action of the moveable jaw to allow the comb to be released from the grip of the gripping element and brings the comb element immediately back into its operating position protruding from the roll.

One of the main disadvantages of this folding device is due to the considerable wear of the comb element and gripping element as a result of the interference which is created after the comb leaves the closed gripping element, beyond the jaw downstream in the rotation direction of the roll.

To avoid wear of both components, the gripping element is generally made of metal whereas the comb element is made of a plastic material, for example nylon. This however causes considerable wear of the comb element which must be frequently substituted to guarantee the correct functioning of the folding device. The rather frequent substitution operation naturally requires the stoppage of the machine and the disassembly of the roll, with consequent problems deriving from an increase in the maintenance costs and a slow-down in production.

A device was therefore produced, for the folding of flexible material capable of reducing the wear of the comb elements and gripping elements, illustrated in Italian patent Nr. 1274311 in the name of the same Applicant. This device comprises mechanical means for moving the comb element from a withdrawn position with respect to the surface of the roll to the protruding or operating position, in which said comb element cooperates with the corresponding gripping element of the opposite roll. The movements of the comb element are synchronized with the movement of the rolls, thus reducing the reciprocal interference between the comb elements and gripping elements and consequently also their wear.

The substitution of both the comb element and the gripping element in a similar device, however, even if less frequent than in traditional machines, requires the complete disassembly of the roll or rolls from the machine, with the relative problems of this type of operation.

A main objective of the present invention is therefore to provide an improved folding device of flexible material capable of solving the above drawbacks of the known art, allowing the maintenance and possible substitution of the comb elements and/or gripping elements, although made of metal and consequently not easily subject to wear, in a simple and rapid manner, without requiring the dismantling of the rolls from the folding machine.

A further objective of the present invention is to provide an improved device for the folding of flexible material which is particularly simple and functional, with reduced costs.

These objectives according to the present invention are achieved by providing an improved device for the folding of flexible material as indicated in claim 1.

Further characteristics of the invention are specified in the subsequent claims.

The characteristics and advantages of an improved device for the folding of flexible material according to the present invention will appear more evident from the following description of a preferred embodiment, provided for illustrative and non-limiting purposes and referring to the enclosed schematic drawings, in which.

Figure 1:
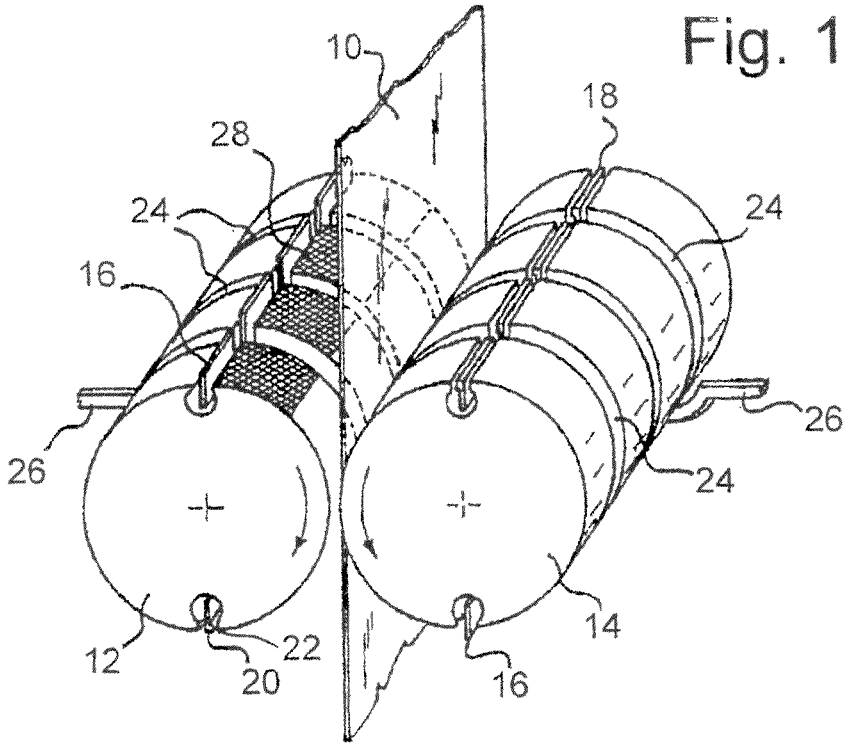
FIG. 1 is a schematic perspective view of a possible embodiment of the folding device according to the invention.

With reference in particular to FIG. 1, this schematically represents a device for the folding of flexible material fed in the form of a continuous strip 10 which is entrained between a pair of parallel and opposite rolls 12 and 14. Each roll is equipped with one or more comb elements 16 and one or more gripping elements 18 arranged along directrix lines parallel to the rotation axes of the rolls 12 and 14, each gripping element 18 consisting of at least one moveable jaw 20 and at least one fixed jaw 22.

As is better illustrated below, the comb elements 16 and moveable jaws 20 of the gripping elements 18 are assembled on respective actuator groups 50 and 52, situated inside each of the rolls 12 and 14, which comprise cam mechanisms for the synchronized activation of the comb elements 16 and gripping elements 18.

On the basis of a particular embodiment of the folding device, the rolls 12 and 14 are equipped with circumferential grooves 24 to allow the housing of one or more rakes 26 which move from a substantially internal position with respect to the profile of the roll to an external position with respect to the above profile. Each roll also has knurled surface portions 28, preferably situated close to the housing seat of the comb element 16, which facilitate the entrainment of the sheet 10 between the rolls 12 and 14 when it is not withheld by one of the gripping elements 18.

Figure 2:
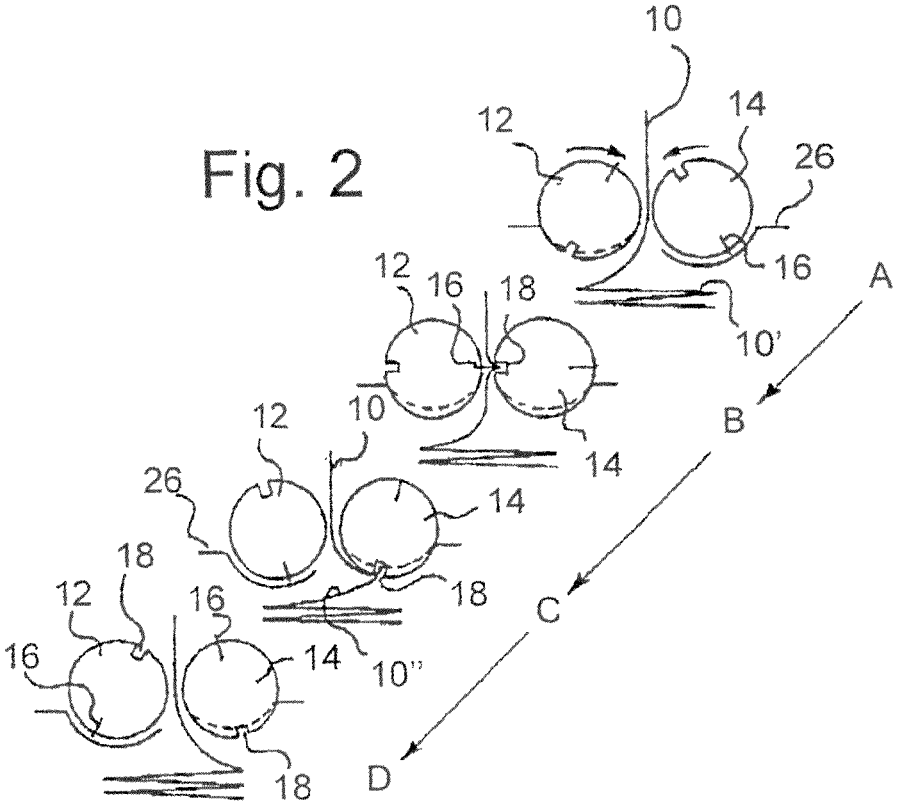
FIG. 2 is a schematic view which shows phases A-D in succession of a folding operation with the device of FIG. 1.

FIG. 2 schematically illustrates the successive phases of a folding operation during the production of a continuous zigzag-folded sheet 10. In particular, in the first illustration in the top right-hand, indicated as phase A, the rake 26 associated with the roll 14 is in a protruding position with respect to the profile of the roll during the passage of the comb element 16 facing the portion 10' of the already folded material. In this case, however, the comb element 16 is in the re-entry phase, or has already completely entered, thus avoiding the danger of the entrainment of the portion of sheet 10' by the comb element 16 onto the roll 14.

By envisaging the re-entry of the comb element 16, the presence of the rakes 26 could also be avoided, with a consequent reduction in the encumbrance of the machine and elimination of the mechanisms necessary for moving the rakes 26. The rolls 12 and 14, as also the comb elements 16 and gripping elements 18, can consequently be produced without the grooves 24 which house the rakes 26, thus simplifying the production and assembly problems of the rolls 12 and 14 themselves. If the rakes 26 are to be maintained for purely precautionary purposes, it is possible to considerably reduce their excursion range to a few mm, thus allowing the production rate of the folding machine to be increased.

In phase B of FIG. 2, the comb element 16 of the roll 12 is moved towards the outside, to a protruding position from the profile of the roll 12, to push the sheet 10 into the gripping element 18 on the roll 14 and thus produce the transversal fold.

In phase C of FIG. 2, the gripping element 18 of the roll 14 is closed and holds the sheet for a certain rotation angle before releasing it, while the comb element 16 of the roll 12 is re-entering. Also in this case, the rake 26 associated with the roll 12 is moved towards the outside for precautionary purposes to prevent interference with the portion 10" of the sheet leaving the folding device and, at the same time, to press the pack of folded sheets towards the cutting blade.

In phase D, the gripping element 18 of the roll 14 has been opened to release the sheet 10 and allow it to be deposited on the rest of the already folded material, while the comb element 16 of the roll 12 is re-entering or has already completely re-entered with respect to the profile of the roll.

Figure 3:
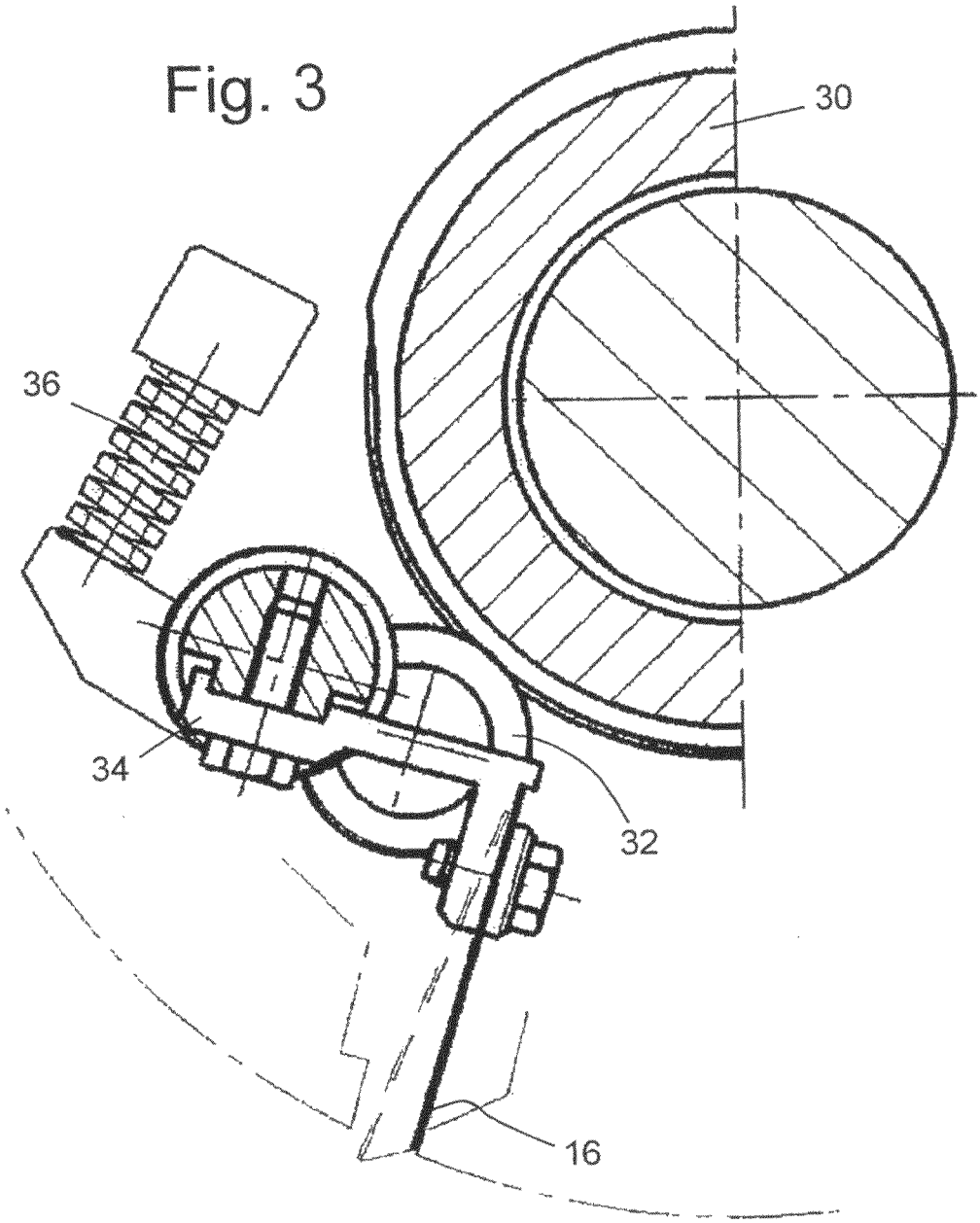
FIG. 3 is a detailed vertical sectional view of the activating cam mechanism of the comb element.
Figure 4:
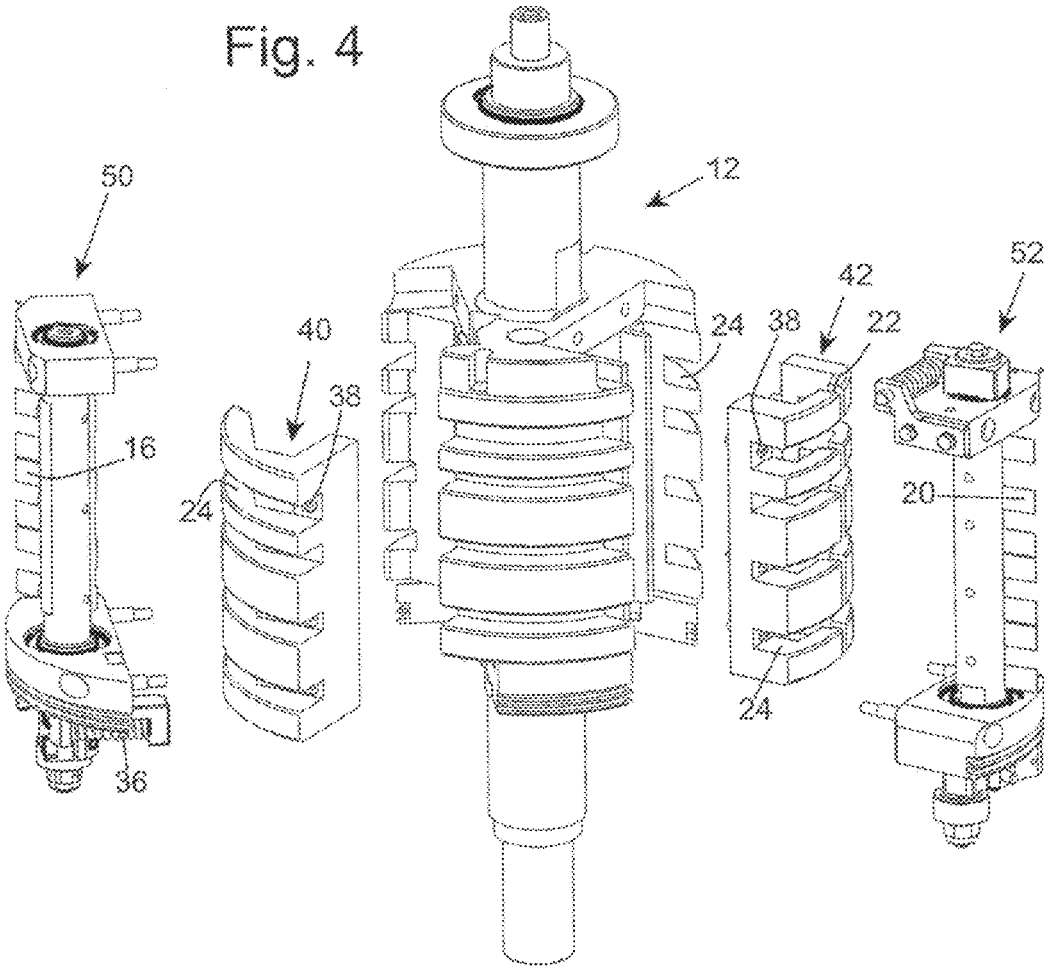
FIG. 4 is an exploded view of the main elements which form each single roll of the folding device of FIG. 1.
Figure 5:
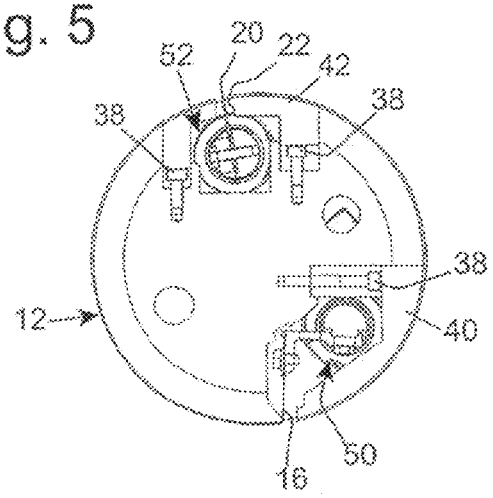
FIG. 5 is a vertical sectional view of the roll illustrated in FIG. 4.

FIGS. 3 and 4 illustrate in detail the actuator group 50 with a cam mechanism which activates the comb element 16 of one or the rolls of the folding device. The actuator group 50 comprises a fixed cam 30 with respect to the rotating roll, whose profile is followed by a cam-follower roll 32 hinged to the end of a lever 34 on which one or more springs 36, suitable for keeping the cam-follower roll 32 in contact with the profile of the cam 30, act, at the opposite end. The comb 16, moved from a protruding position to a withdrawn position with respect to the profile of the roll 12 or 14 by the mechanism described so far, is therefore constrained to the lever 34 and in an opposite position to the spring or springs 36.

Analogously, the moveable jaws 20 of the gripping element 18, as can be seen in FIG. 4, are also assembled on a suitable cam actuator group 52 which allows them to be moved towards and away from the fixed jaws 22 during the processing of the sheet 10.

As illustrated in the exploded view of FIG. 4, each roll 12 and 14 is advantageously equipped, in correspondence with each of the actuator groups 50 and 52 of the comb elements 16 and gripping elements 18 respectively, with relative disassemblable caps 40 and 42 which allow access and possible substitution of the whole actuator groups 50 and 52 or part of these, without disassembling the entire roll 12 or 14 from the folding device.

The caps 40 and 42 extend for the whole or part of the length in an axial direction of the respective rolls 12 and 14 and are constrained to said rolls by means of one or more fixing elements 38, such as screws, for example, which are directly accessible from the front surface of the caps 40 and 42. This front surface of the caps 40 and 42 therefore have a curvature radius equal to the radius of the roll 12 or 14 so that, when the caps 40 and 42 are assembled, each roll 12 and 14 has a perfectly smoothed surface to avoid damage to the sheet 10 during the processing.

Furthermore, by envisaging the presence of rakes 26 and relative circumferential grooves 24, part of these grooves 24 are obtained on the front surface of the caps 40 and 42, as can be seen in FIG. 4.

Finally, the fixed jaws 22, which cooperate with the moveable jaws 20 moved by the actuator group 52 itself, are obtained on the cap 42 which covers the actuator group 52 of the gripping elements 18, so that when a certain wear of the whole of the gripping element 18 is reached, only the cap 42 must be substituted and not the entire surface of the roll on which said cap 42 is fixed.

It can therefore be seen that the improved device for the folding of flexible material according to the present invention achieves the objectives indicated above, allowing easy access to the actuator groups of the comb elements and gripping elements for their maintenance and possible substitution without having to dismantle the rolls from the folding device.

The improved device for the folding of flexible material of the present invention thus conceived, can in any case undergo numerous modifications and variants, all included in the same inventive concept. Furthermore, in practice, the materials used, as also the dimensions and components, can vary according to technical requirements.

The invention claimed is:

1. A device for the folding of flexible material in the form of a continuous strip (10) into a continuous zigzag folded sheet said device consisting of a first roll (12) and a second roll (14) arranged as a pair of parallel and opposite rolls (12, 14) each of said rolls being equipped with at least one gripping element (18), consisting of at least one moveable jaw (20) and at least one fixed jaw (22), and at least one comb element (16) situated along directrix lines parallel to the axes of the respective rolls (12, 14), said comb element (16) being assembled on an actuator group (50) inside each of the rolls (12, 14) where said comb element (16) is adapted to be moved from a substantially withdrawn position with respect to the surface of said roll (12, 14) to a protruding position where said actuator group (50) inside of each of the rolls (12,14) comprises cam mechanisms for the synchronized activation of the comb elements (16) and gripping elements (18), said at least one comb element (16) of said first roll (12) being adapted to move to the outside of the roll (12) to push the continuous strip (10) into said at least one gripping element (18) of said second roll (14), said at least one comb element of said second roll (14) being adapted to move to the outside of the roll (14) to push the continuous strip (10) into said at least one gripping element (18) of said first roll (12) to produce transverse folds that produce a continuous zigzag sheet, said at least one moveable jaw (20) of the gripping element (18) being assembled on an actuator group (52) inside each of the rolls (12, 14) to allow it to be moved towards and away from said at least one fixed jaw (22), characterized in that each roll (12, 14) is equipped with one or more disassemblable caps (40, 42) respectively situated in correspondence with each of said actuator groups (50, 52) to allow access to said actuator groups (50, 52) and substitution of said actuator groups (50, 52) with a replacement actuator group (50,52) without dismantling said rolls (12, 14) from the folding device where said at least one fixed jaw (22) which cooperates with said at least one moveable jaw (20) moved by said actuator group (52) is provided on the cap (42), wherein said rolls (12, 14) comprise a plurality of circumferential grooves (24) suitable for housing a plurality of moveable rakes (26), at least a part of said circumferential grooves (24) being situated on the front surface of said caps (40, 42).

2. The device according to claim 1, characterized in that said caps (40, 42) extend for the whole or part of the length in an axial direction of the respective rolls (12, 14).

3. The device according to claim 1, characterized in that said caps (40, 42) are constrained to said rolls (12, 14) by means of one or more respective fixing elements (38) directly accessible from the front surface of said caps (40, 42).

4. The device according to claim 1, characterized in that the front surface of said caps (40, 42) has a curvature radius equal to the radius of said rolls (12, 14).

* * * * *